US005608973A

United States Patent [19]

Karlstedt et al.

[11] Patent Number: 5,608,973

[45] Date of Patent: Mar. 11, 1997

[54] ARRANGEMENT FOR LOWERING THE NOISE LEVEL OF A COOLING LAYER IN A PULP DRYER AND A PULP DRYER

[75] Inventors: Bertel Karlstedt, Parainen; Henrik Pettersson, Mynämäki, both of Finland

[73] Assignee: Valmet Corporation, Helsinki, Finland

[21] Appl. No.: 492,657

[22] Filed: Jun. 20, 1995

[30] Foreign Application Priority Data

Jun. 29, 1994 [FI] Finland ..... 943115

[51] Int. Cl.[6] ..... F26B 25/06

[52] U.S. Cl. ..... 34/60; 34/643

[58] Field of Search ..... 34/60, 279, 640, 34/641, 643; 415/119

[56] References Cited

U.S. PATENT DOCUMENTS

| | | | |
|---|---|---|---|
| 3,113,634 | 12/1963 | Watters | 415/119 |
| 3,251,540 | 5/1966 | Kinsworthy | 415/119 |
| 3,799,703 | 3/1974 | Paine et al. | 415/119 |
| 3,918,171 | 11/1975 | Hull | 34/243 |
| 4,020,561 | 5/1977 | Mathews | 34/13 |
| 4,089,122 | 5/1978 | Gust et al. | 34/79 |
| 4,173,831 | 11/1979 | McCord | 34/236 |
| 4,805,318 | 2/1989 | Brahlette et al. | 34/57 A |
| 5,044,705 | 9/1991 | Nelson | 312/228 |
| 5,060,752 | 10/1991 | Heiberger | 34/243 C |
| 5,423,395 | 6/1995 | Kieffer | 181/202 |

FOREIGN PATENT DOCUMENTS 3811248 10/1989 Germany .

*Primary Examiner*—Edward K. Look
*Assistant Examiner*—Michael S. Lee
*Attorney, Agent, or Firm*—Steinberg, Raskin & Davidson, P.C.

[57] ABSTRACT

An arrangement for lowering the noise level in connection with a cooling layer in a pulp dryer having a heat-insulated bottom wall and top wall constituting a sound-attenuating construction and a wall at the inlet side of the cooling layer also constituting a sound-attenuating construction. At the outlet side of the air flow from the cooling layer in the pulp dryer, sound-attenuation baffles are arranged preferably perpendicular to or inclined in relation to the direction of the air flow and which are placed at a distance from one another.

20 Claims, 4 Drawing Sheets

ARRANGEMENT FOR LOWERING THE NOISE LEVEL OF A COOLING LAYER IN A PULP DRYER AND A PULP DRYER

FIELD OF THE INVENTION

The present invention relates to an arrangement for lowering the noise level in connection with a cooling layer in a pulp dryer and a pulp dryer.

BACKGROUND OF THE INVENTION

In pulp drying of a web, integration of cooling capacity with the drying concept has become common quite quickly. One of the reasons for this rapid acceptance of cooling/drying integration is a process-technical reason, for example, the reliability of operation of a slitter. Recently, a more important reason has been the introduction of a chlorine-free production process (TCF) in which the brightness of the pulp is initially somewhat inferior to that of pulp bleached with chlorine. Baling or reeling when the web is excessively hot results in manila coloring of the paper produced from the web, as a result of which the brightness of the paper, which is an important criterion of quality, is lowered.

Cooling capacity is provided in existing machines by adding separate cooling units in connection with the pulp dryer. In new machines, the cooler is more and more frequently constructed as an integrated part of the dryer proper.

As the art progresses, stricter requirements are imposed on the prevention of noise generated by paper machines and particularly pulp dryers. In particular, in the paper-making industry, in various machine halls, the prevention of noise has been dealt with in a number of different locations. In view of the prevention of noise, particularly demanding objects are the mills of pulp industry, in particular the cooling layer in a pulp dryer.

An air cooler for pulp is based on a technique in which air from the machine hall or cooled air is blown through air nozzles against the web face. The air is introduced into the cooler by means of blowers which may be either attached to the side of the cooler/dryer or separate devices placed at a distance from the cooler/dryer unit. Most commonly, in both cases, the blown air is discharged from nozzle gaps freely into the machine hall. In such a case, the noise of the blowers, nozzles, and the other process noise have access to be spread freely into the machine hall. Of course, in the other respects, a pulp dryer is a heat-insulated and thus, at the same time, a partly sound-insulated closed unit, whose noise level does not become very high.

The noise from the blowers and from the air flow in the cooling layer of a pulp dryer has free access into the machine hall. In some cases (and with stricter regulations, more and more often) this results in a noise level that is not within permissible limits.

The sound attenuation/insulation in the cooling layer in a pulp dryer is important, for a pulp dryer machine is, even otherwise, a noisy process in which it is important to avoid additional noise and to eliminate existing noise.

OBJECTS AND SUMMARY OF THE INVENTION

An object of the present invention is to provide a solution for lowering the noise level arising from the cooling layer of a pulp dryer.

In view of achieving the object stated above and others, the inventive pulp dryer has a cooling layer having a heat-insulated bottom wall and top wall provided with perforated sheets so that the heat-insulation material also operates as a sound-attenuation material at the same time.

In accordance with the invention, embodiments of a cooling layer integrated with the dryer construction are described so as to avoid the problems in the prior art constructions mentioned above.

The top face and the bottom face of the cooling layer in the pulp dryer are modified so that they are made of a perforated sheet (normally of solid sheet) or apertured sheet, behind which wall there is wool. In this case, the blower noise and the flow noise arising in the blowers are attenuated efficiently as the top face and the bottom face operate on the absorption principle. The wool, which operates as a thermal insulation in the construction, now also operates as a sound attenuator.

The cooling-air blower, which is placed at the driving side, is arranged in the interior of the dryer construction in an attenuated space, in which case its noise insulation toward the machine hall is efficient. At the suction side of the blower, a noise attenuator is placed to attenuate the noise at the suction side of the blower.

In certain alternative constructions, the blower and the noise attenuator can be turned so that they are placed longitudinally in relation to the dryer. In this case, the sound attenuation/insulation is improved further as the blower and the attenuator are placed in a sound-attenuated space.

At the discharge side of the cooling air, baffles that absorb sound are placed inside the cooling layer whereby the noise is attenuated even further.

When the cooling layer is placed separate from the dryer unit, the constructions described above can be accomplished in the same general manner. However, as an alternative, the discharge of the air at the outlet side can also be arranged, for example, so that the air is discharged upward into the machine hall.

At the tending side, sound-absorbing wall panels and/or slide doors or entrance doors are arranged. Before being discharged into the hall, the air still passes through sound-absorbing baffles.

In an integrated dryer, the cooling layer and the intake-air chamber placed above the layer are separated by means of an insulated floor construction. At both sides of the floor, dry air (from the machine hall) is treated. In a separate cooler positioned above the slitter, there is a floor construction which can be insulated readily in view of its specific positioning.

Owing to the construction of the cooler, it is possible to provide the existing constructions with sound-attenuation capacity. At the same time, by means of various baffles and special arrangements, it is also possible to attenuate the noise at the blower, among other things, by means of its location.

Briefly, the cooling layer of a pulp dryer in accordance with the invention includes nozzles through which air is blown to support a web, and a top wall and a bottom wall spaced therefrom defining a space in which the nozzles are arranged. The top wall and bottom wall each comprise sheet means and thermal insulation means situated adjacent the sheet means and exterior of the space. The sheet means comprise apertures formed therein for allowing sound generated in the space to be passed into the thermal insulation means to be absorbed thereby such that the thermal insulation means act as sound attenuation means, i.e., constitute unitary means for providing both thermal insulation and sound attenuation. An inlet side wall may be arranged to extend substantially between the top wall and the bottom wall, whereby air for the nozzles is directed through the cooling layer in a direction away from the inlet side wall. The inlet side wall ideally comprises sound-attenuating means. Further, an outlet side of the cooling layer is defined between the top wall and the bottom wall outside of an area in which the nozzles are situated, and sound-attenuation baffles are arranged in the outlet side perpendicular to or inclined in relation to the direction of the air flow and placed at a distance from one another. The outlet side of the cooling layer may additionally or alternatively comprise a wall having a sound-insulation panel, an openable door having sound-insulation means or a duct coupled to the outlet side for directing air from the outlet side upward and sound-attenuation baffles arranged in the duct. In the latter case, the duct is lined with a sound-attenuation/insulation material. The thermal insulation means comprise wool material situated behind the sheets of material.

The pulp dryer in accordance with the invention comprises a dryer part having a plurality of nozzles through which air is blown against a web to dry the web, a cooling layer situated after the dryer part in a running direction of the web and having a plurality of nozzles through which air is directed at the web to cool the web, and means defining a replacement air space between the dryer part and the cooling layer. The cooling layer comprises a top wall and a bottom wall spaced therefrom defining a space in which the plurality of nozzles are arranged. The top wall and bottom wall comprise means for providing thermal insulation and sound attenuation, preferably an apertured or perforated sheet of material with wool material situated behind the material. The same aspects of the cooling layer described above may be applied in the cooling layer of the pulp dryer in accordance with the invention.

In the following, the invention will be described in detail with reference to the figures in the accompanying drawing. However, the invention is not strictly confined to the details of the figures.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
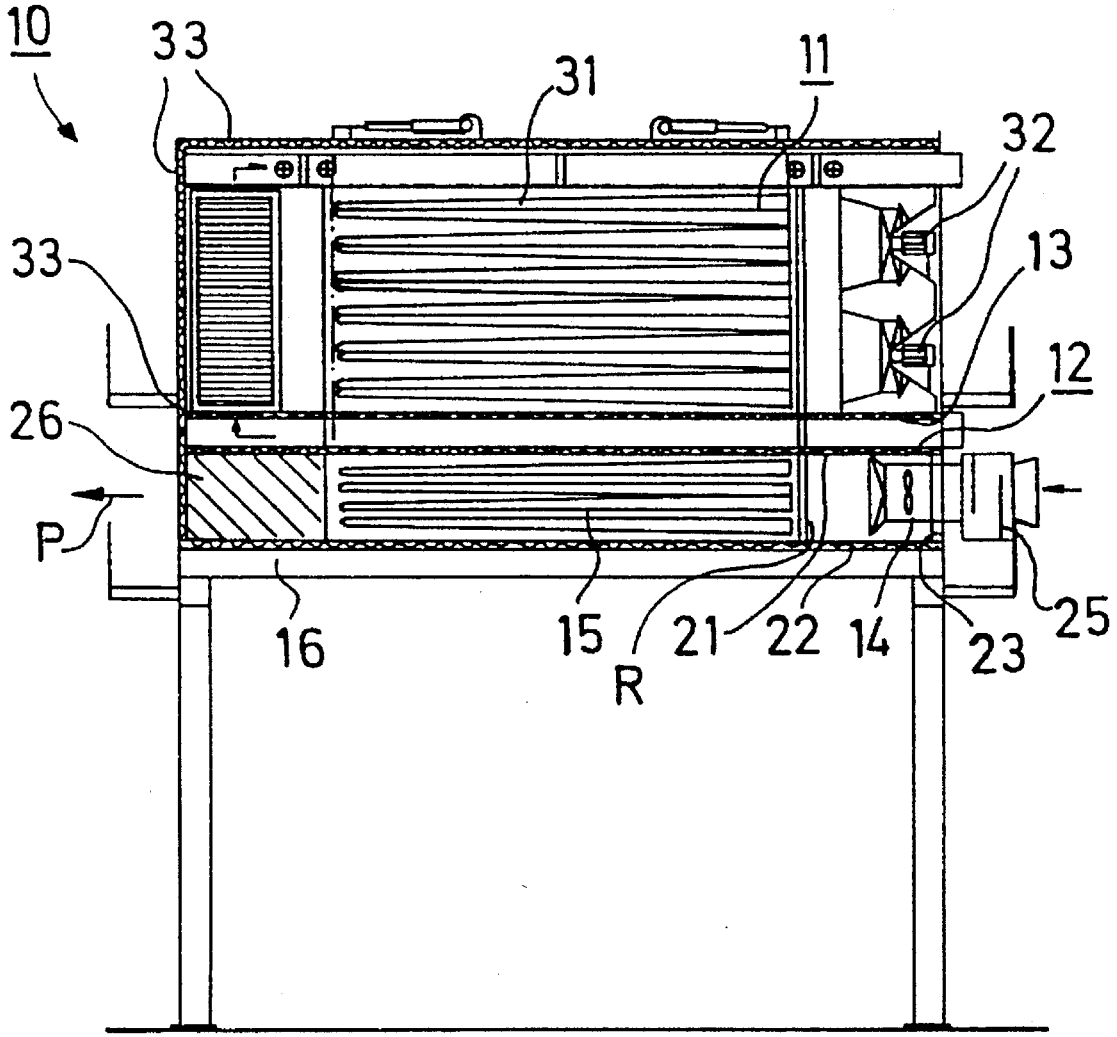
FIG. 1 is a sectional side view of an exemplifying embodiment of a pulp dryer in accordance with the invention.

Referring to the accompanying drawings wherein the same reference numerals refer to the same or similar elements, according to FIG. 1, a pulp dryer is denoted generally at 10 and comprises a dryer part 11 and a cooling layer 12. In the dryer part 11, heated drying air is blown against the face of the web running in nozzle gaps 31 which are gaps between rows of nozzles in the dryer part 11. From the dryer part 11, the web is passed into the cooling layer 12, in which air taken from the machine hall or from the open air is blown through nozzles against the face of the web running in nozzle gaps 15, i.e., gaps between the rows of nozzles. A blower 14 of a cooling unit or cooler R is placed in contact with a wall of the cooling layer 12 so that it is placed inside the dryer construction 10. The cooling air is discharged from the opposite end of the cooling layer 12 freely into the machine hall, as is indicated by arrow P. The dryer part 11 and a replacement air space 13 are surrounded by a heat-insulation material 33 which operates as a sound insulation or attenuation at the same time.

The construction of the top and bottom faces of the cooling layer 12 and wall constructions 21,22,23 at the inlet side is both heat-insulating and also sound-attenuating, for example, by means of a perforated sheet. The blower 14, by whose means air is blown into the cooling layer 12, is placed inside the dryer construction 10, i.e., inside the space defined by the assembly of the sound-attenuating wall constructions 21,22,23, and the blower 14 is also provided with a sound attenuator 25 at the suction side. At the outlet side of the cooling layer 12, sound-attenuation baffles 26 are placed at a distance L (FIG. 3) from one another, L being from about 100 mm to about 1000 mm, preferably about 900 mm.

Figure 2:
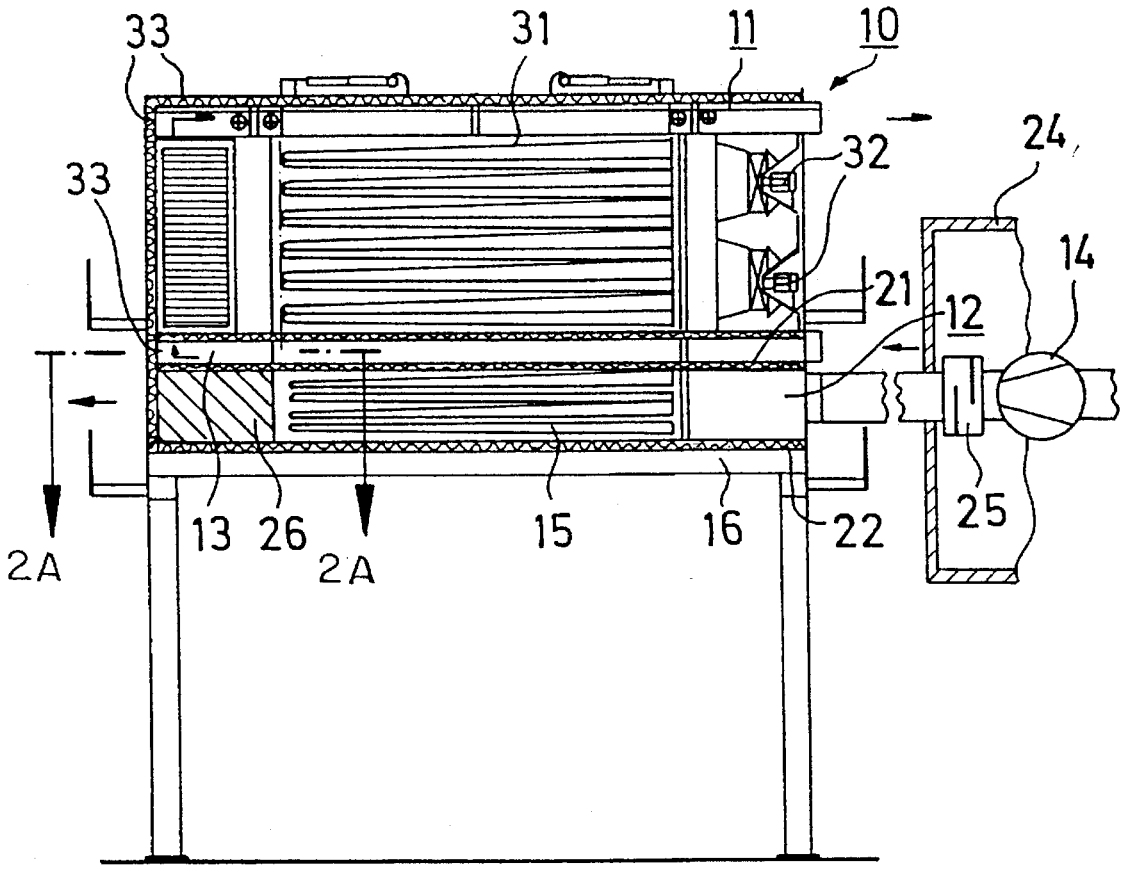
FIG. 2 is a sectional side view of a second exemplifying embodiment of a pulp dryer in accordance with the invention.

In the exemplifying embodiment shown in FIG. 2, the blower 14 of the cooling layer 12 of the pulp dryer 10 is placed apart and at a distance from the dryer 10, and the blower 14 is surrounded by a sound-insulation housing 24. In other respects, the exemplifying embodiment shown in FIG. 2 is similar to that shown in FIG. 1, and the same reference numerals denote corresponding parts.

The wall construction 21 placed on the top face of the cooling layer 12 is the intermediate floor placed between the replacement air space 13 and the cooling layer 12 in the pulp dryer 10. The wall construction 22 at the bottom of the cooling layer 12 is preferably a part of the floor construction 16 of the pulp dryer 10. The top and bottom faces of the cooling layer 12 operate on the absorption principle, and the wool or equivalent that is used as the sound-attenuation material also operates as thermal insulation. The sound-attenuation baffles 26 are made of a material that absorbs sound, for example mineral wool or foam plastic. The sound-attenuation baffles 26 attenuate the flow noise of the air flow discharged at the outlet side of the cooling layer.

The wall constructions 21,22 placed at the top and bottom of the cooling layer 12 in the pulp dryer 10 are preferably made of a perforated sheet, i.e., a sheet having perforations or aperture whose hole size is from about 4 mm to about 10 mm, preferably only 4 mm, and the proportion of holes to solid material of the sheet is from about 25% to about 50%, preferably only 26%, as well as of a thermal-insulation/sound-attenuation material placed behind the perforated sheet, such as wool.

The sound attenuation baffles 26 placed at the outlet side are preferably made of a perforated sheet which forms the outer face, in which the hole size of the perforations or apertures in the sheet is from about 4 mm to about 10 mm, preferably only about 8 mm, and the hole proportion is from about 25% to about 50%, preferably only about 45%, and of a sound-attenuation material placed inside the perforated plate, such as wool.

Figure 2A:
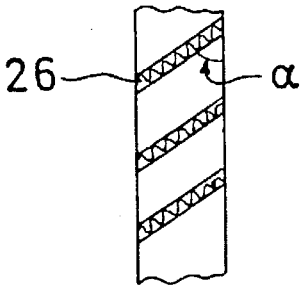
FIG. 2A is a view in part of FIG. 2, viewed in the direction of the line 2A—2A.

FIG. 2A shows the sound-attenuation baffles 26 at the discharge side, viewed from above (direction 2A—2A, FIG. 2). The baffles 26 are placed vertically and at a horizontal distance from one another. The sound-attenuation baffles 26 may be inclined at an angle α in relation to the direction of the air flow to provide a large engagement between the air and the baffles. The angle α is from about 50° to about 90°, preferably about 68°.

Figure 3:
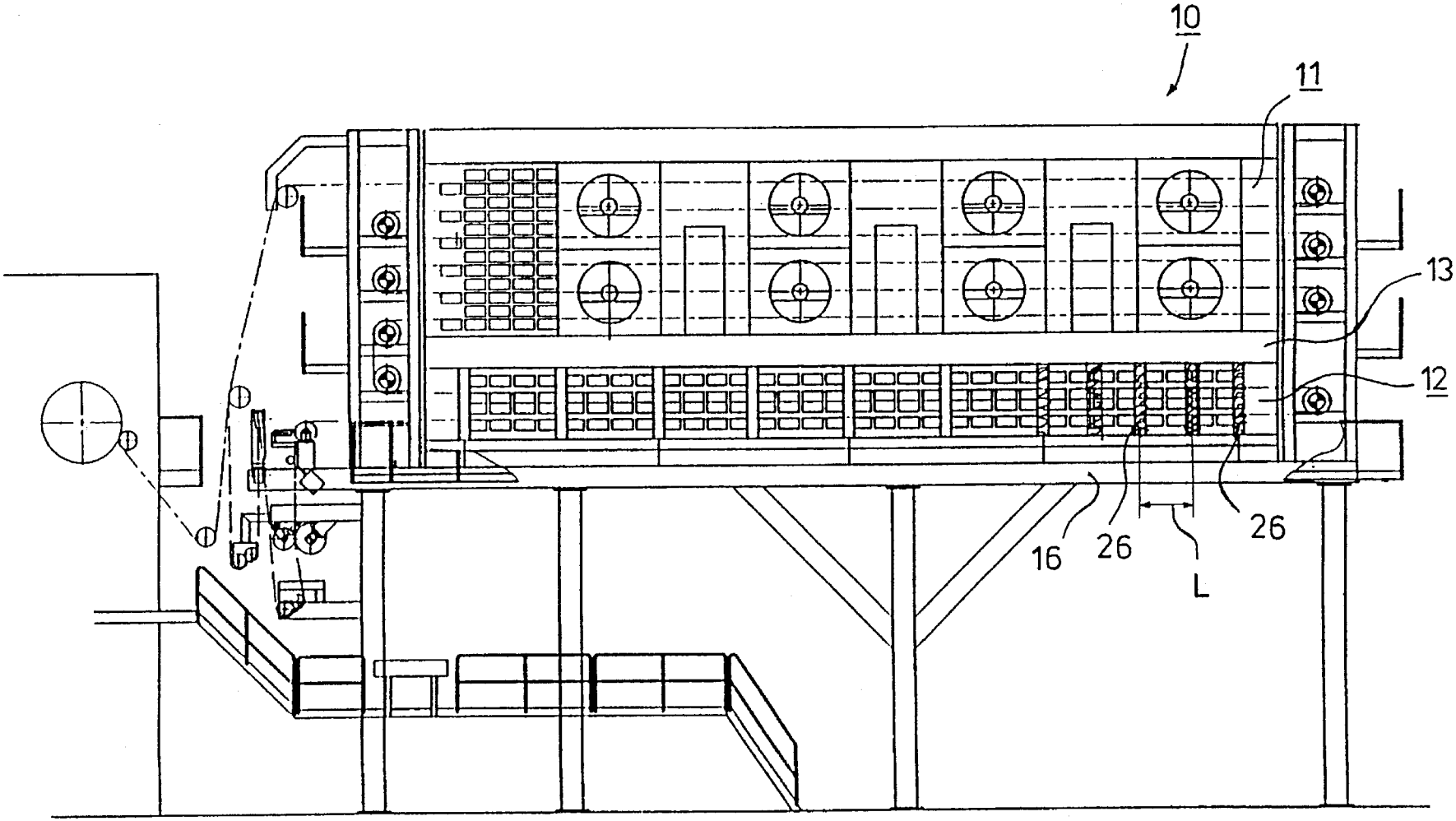
FIG. 3 is a sectional view of a pulp dryer in accordance with the invention in the longitudinal direction.

In the longitudinal sectional view of a pulp dryer shown in FIG. 3, the sound-attenuation baffles 26 are seen. The baffles 26 are placed at the outlet side of the air flow in the cooling layer 12 in the pulp dryer 10 and are preferably made of low-weight construction, while the sound-attenuation material is, for example, foam plastic or mineral wool.

Figure 4:
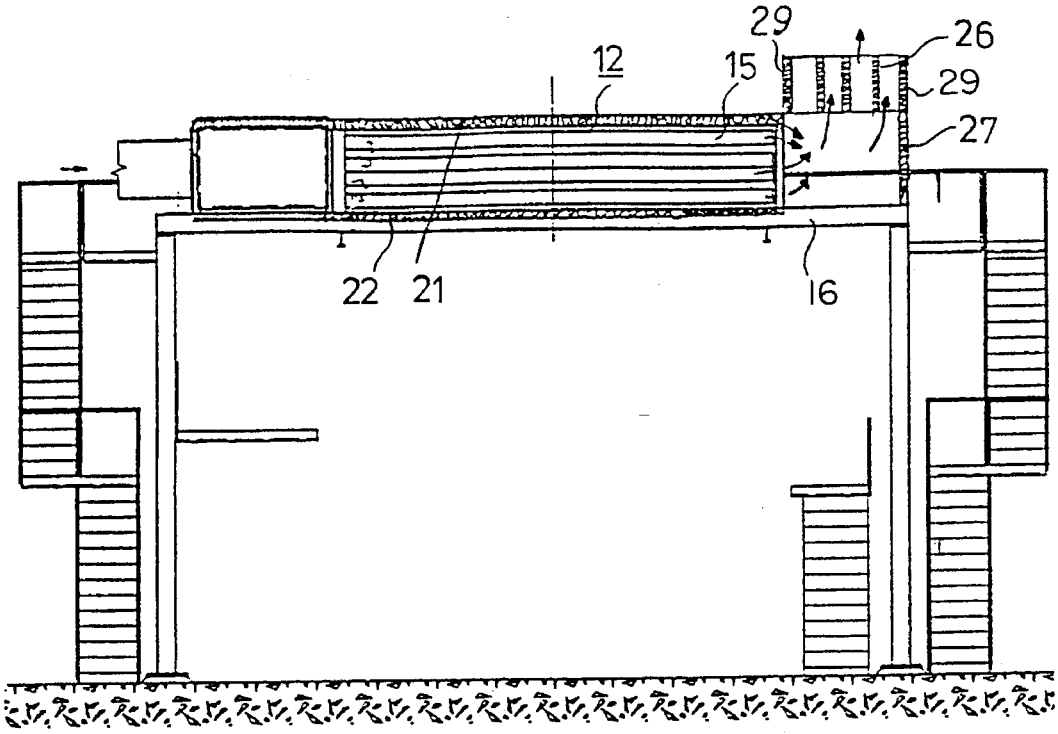
FIG. 4 is a sectional view of an exemplifying embodiment of a cooling layer in a pulp dryer in accordance with the invention.
Figure 5:
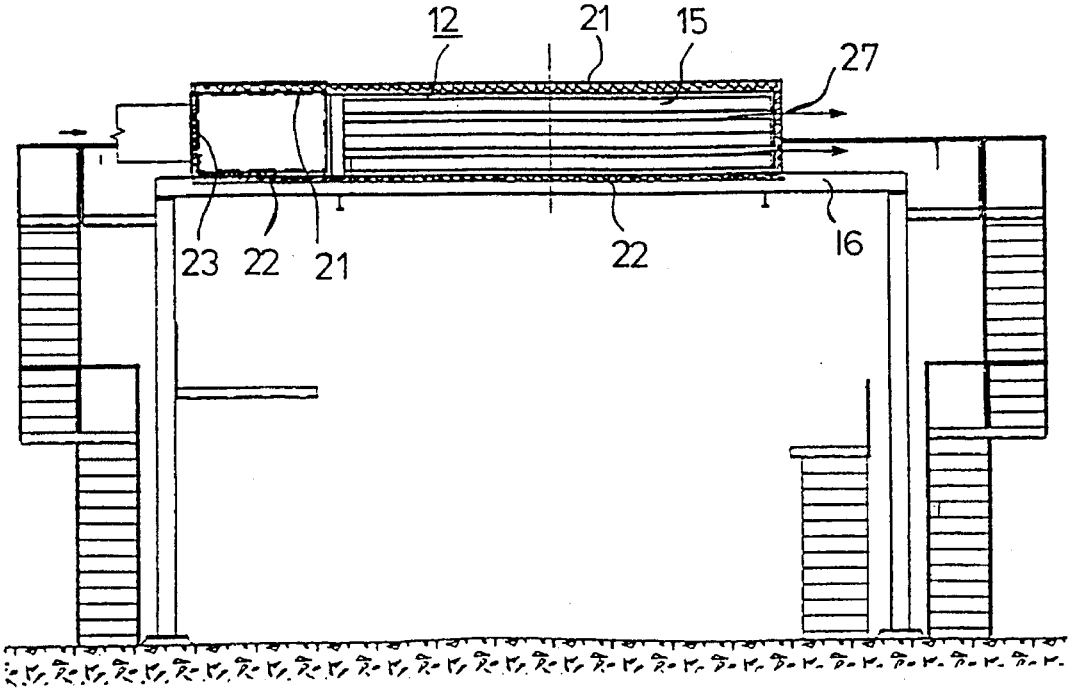
FIG. 5 is a sectional view of a second exemplifying embodiment of a cooling layer in a pulp dryer in accordance with the invention.

FIGS. 4 and 5 illustrate a sound-attenuation construction of a cooling layer separate from the pulp dryer, in which construction the heat-insulated constructions 21,22 of the bottom wall and the top wall of the cooling layer 12 are made from a perforated sheet, i.e., a sheet having perforations or apertures with a hole size from about 4 mm to about 10 mm, preferably only about 4 mm, and the proportion of holes to solid material is from about 25% to about 50% preferably only about 26%, and behind which an attenuation material is placed, such as wool.

In the exemplifying embodiment as shown in FIG. 4, the discharge of the air, indicated by the arrows, at the outlet side of the cooling layer 12 is arranged so that the air is discharged upwards into the hall through the sound-attenuation baffles 26 in the duct lined with sound-attenuation plates 29. The baffles attenuate the noise as the discharge air flows between them.

In the exemplifying embodiments shown in FIGS. 4 and 5, at the tending side of the cooling layer 12 separate from the dryer unit, sound-absorbing wall panels and/or slide/entrance doors 27 are provided. The construction of a sound-attenuation panel/door 27 may also be of lattice construction.

In connection with the exemplifying embodiments as shown in FIGS. 4 and 5, it is also possible to use the sound-attenuation arrangements described above in relation to FIGS. 1–3.

According to the invention, the wall constructions 21,22, 23,24,25,26,27,29 in the cooling layer 12 in the pulp dryer 10 have been accomplished so that, by means of combinations suitable for each exemplifying embodiment, the noise level of the cooling layer 12 in the pulp dryer 10 has been lowered substantially. FIGS. 1, 2, 4 and 5 show the sound-attenuating floor construction 22 of the pulp cooler 12 as well as the sound-attenuating intermediate-floor construction 21 of the replacement air space 13. At the outlet side of the air flow in the cooling layer 12, in the exemplifying embodiments as shown in FIGS. 1–3, sound-attenuation baffles 26 are placed which reduce the noise at the discharge side. FIG. 1 shows an embodiment in which the axial blower is placed in a sound-attenuated space inside the cooling layer 12, the blower being provided with an intake-side sound attenuator 25. In FIG. 2, the blower 14 is provided with a sound-attenuation housing 24 and with a sound attenuator 25 at the pressure side. FIG. 3 shows the sound-attenuation baffles 26 at the outlet side, which have preferably a low-weight. FIGS. 4 and 5 show exemplifying embodiments in which the air outlet side is additionally provided with sound-insulating panels/doors 27, and in the exemplifying embodiment shown in FIG. 4 the air flow at the air outlet side is directed upward through the baffles 26 placed in a sound-insulated duct.

The examples provided above are not meant to be exclusive. Many other variations of the present invention would be obvious to those skilled in the art, and are contemplated to be within the scope of the appended claims.

We claim:

1. In a cooling layer of a pulp dryer including a top wall and a bottom wall spaced therefrom defining a space, means for passing a fibrous web through said space and nozzles arranged in said space and through which air is blown to support and dry the web, the improvement comprising each of said top wall and said bottom wall comprising sheet means and thermal insulation means situated adjacent said sheet means and exterior of said space, said sheet means comprising apertures formed therein for allowing sound generated in said space to be passed into said thermal insulation means to be absorbed such that said thermal insulation means act as sound attenuation means.

2. The arrangement of claim 1, further comprising an inlet side wall extending substantially between said top wall and said bottom wall, air for the nozzles being directed through the cooling layer in a direction away from said inlet side wall, said inlet side wall comprising sound-attenuating means.

3. The arrangement of claim 1, further comprising an outlet side of said cooling layer defined between said top wall and said bottom wall outside of an area in which the nozzles are situated, and sound-attenuation baffles arranged in said outlet side.

4. The arrangement of claim 3, wherein said attenuation baffles are arranged perpendicular to or inclined in relation to the direction of the air flow and placed at a distance from one another.

5. The arrangement of claim 2, further comprising a blower for blowing air through said cooling layer between said top wall and said bottom wall, said blower being arranged in a space defined by said top wall, said bottom wall and said inlet side wall.

6. The arrangement of claim 1, further comprising a blower for blowing air through said cooling layer between said top wall and said bottom wall, and a sound-attenuation housing separate from the pulp dryer, said blower being arranged in said housing.

7. The arrangement of claim 1, further comprising an outlet side of said cooling layer defined between said top wall and said bottom wall outside of an area in which the nozzles are situated, said outlet side comprising a wall having a sound-insulation panel.

8. The arrangement of claim 1, further comprising an outlet side of said cooling layer defined between said top wall and said bottom wall outside of an area in which the nozzles are situated, said outlet side comprising an openable door having sound-insulation means.

9. The arrangement of claim 1, further comprising an outlet side of said cooling layer defined between said top wall and said bottom wall outside of an area in which the nozzles are situated, a duct coupled to said outlet side for directing air from said outlet side upward, and sound-attenuation baffles arranged in said duct.

10. The arrangement of claim 9, wherein said duct is lined with a sound-attenuation/insulation material.

11. The arrangement of claim 1, wherein said sheet means comprise an apertured or perforation sheet of material and said thermal insulation means comprise wool material.

12. The arrangement of claim 1, wherein said sheet means comprise a perforated sheet having perforations having a size from about 4 mm to about 10 mm, the proportion of perforations to solid material in said perforated sheet being from about 25% to about 50%.

13. A pulp dryer, comprising a dryer part having a plurality of nozzles through which air is blown against a web to dry the web, a cooling layer situated after said dryer part in a running direction of the web, said cooling layer having a plurality of nozzles through which air is directed at the web to cool the web, and means defining a replacement air space between said dryer part and said cooling layer, said cooling layer comprising a top wall and a bottom wall spaced therefrom defining a space in which said plurality of nozzles are arranged, each of said top wall and said bottom wall comprising sheet means and thermal insulation means situated adjacent said sheet means and exterior of said space, said sheet means comprising apertures formed therein for allowing sound generated in said space to be passed into said thermal insulation means to be absorbed such that said thermal insulation means act as sound attenuation means.

14. The dryer of claim 13, wherein said top wall defines a lower wall of said replacement air space.

15. The dryer of claim 13, wherein said cooling layer further comprises side walls extending between said top wall and said bottom wall, said side walls comprising unitary means for providing thermal insulation and sound attenuation.

16. The dryer of claim 13, wherein said cooling layer further comprises an inlet side wall extending substantially between said top wall and said bottom wall, air for said plurality of nozzles being directed through the cooling layer in a direction away from said inlet side wall, said inlet side wall comprising sound-attenuating means.

17. The dryer of claim 13, wherein said cooling layer further comprises an outlet side of said cooling layer defined between said top wall and said bottom wall outside of an area in which the nozzles are situated, and sound-attenuation baffles arranged in said outlet side, said-attenuation baffles being arranged perpendicular to or inclined in relation to the direction of the air flow and placed at a distance from one another.

18. The dryer of claim 16, further comprising a blower for blowing air through said cooling layer between said top wall and said bottom wall, said blower being arranged in a space defined by said top wall, said bottom wall and said inlet side wall.

19. The dryer of claim 13, further comprising a blower for blowing air through said cooling layer between said top wall and said bottom wall, and a sound-attenuation housing separate from the pulp dryer, said blower being arranged in said housing.

20. The dryer of claim 13, further comprising an outlet side of said cooling layer defined between said top wall and said bottom wall outside of an area in which the nozzles are situated, a duct coupled to said outlet side for directing air from said outlet side upward, and sound-attenuation baffles arranged in said duct.

* * * * *